United States Patent [19]

Frahm et al.

[11] 4,416,383

[45] Nov. 22, 1983

[54] CLOSURE AND SEALING DEVICE

[76] Inventors: Carl E. Frahm, 1428 Oak Meadow Rd., Arcadia, Calif. 91006; Erick L. Larson, 4916 Del Monte Rd., La Canada, Calif. 91001; John M. S. McAulay, 2412 W. 227th St., Torrance, Calif. 90501

[21] Appl. No.: 316,239

[22] Filed: Oct. 29, 1981

[51] Int. Cl.[3] ..... B65D 41/48

[52] U.S. Cl. ..... 215/256; 215/270; 215/344; 215/DIG. 1

[58] Field of Search ..... 215/270, 256, 344, DIG. 1

[56] References Cited

U.S. PATENT DOCUMENTS

| | | | |
|---|---|---|---|
| 2,768,762 | 10/1956 | Guinet | 215/344 X |
| 3,770,156 | 11/1973 | Yates | 215/DIG. 1 |
| 3,860,137 | 1/1975 | Wilson | 215/256 X |
| 4,106,653 | 8/1978 | Martinelli | 215/DIG. 1 |

FOREIGN PATENT DOCUMENTS

| | | | |
|---|---|---|---|
| 202476 | 3/1959 | Austria | 215/344 |
| 860137 | 1/1971 | Canada | 215/256 |
| 1526780 | 4/1968 | France | 215/256 |

*Primary Examiner*—Donald F. Norton
*Attorney, Agent, or Firm*—Lyon & Lyon

[57] ABSTRACT

A closure and sealing device for closing and sealing an open-mouthed vessel having a vessel neck and further having an orifice defined by a vessel neck lip protruding axially and radially from said orifice. A bottle cap in accordance with the preferred embodiment is designed to prevent the transfer of liquid or gas between the interior of the bottle and the atmosphere and includes two elongated, tapered sealing members disposed around the interior perimeter of the cap with the sealing members angularly disposed such that they diverge from each other. The tapered ends of the elongated sealing members are adapted to make firm contact against the top and side of the lip. Seal augmenting means consisting of a relatively massive protruding region disposed around the interior perimeter of the cap below the sealing members are adapted to urge the sealing members into sealing contact with the lip and acts as a third sealing member. When the closure device is placed over the lip, a depending skirt portion extends down the outside of a vessel neck to cover and seal against a second protruding bottle neck lip located axially downward from the orifice defining lip, and an opening tab depends from the lower portion of the skirt. One side of the tab leads into an opening groove formed in the exterior of the skirt such that pulling the tab tears the closure device for removing the closure device from the vessel.

11 Claims, 4 Drawing Figures

CLOSURE AND SEALING DEVICE

BACKGROUND OF THE INVENTION

This invention relates to the field of closure and sealing devices, and in particular to an improved closure and sealing device for open-mouthed vessels such as bottles.

The bottled water industry is a major user of closure devices, for example bottle caps on 5-gallon bottles. These caps must of necessity be inexpensive to manufacture, as well as easy to place on the bottle and to remove. A desirable characteristic of bottle caps with which the present invention is particularly concerned is the prevention of the transfer of gas and liquid between the inside of the bottle and the atmosphere. If water escapes from the bottle during storage, then the consumers will become dissatisfied. Conversely, since a prime reason for purchasing bottled water is its purity, it is of the utmost importance that the bottle cap seal the bottle against contamination from the atmosphere. Maintaining a pure and full bottle of water becomes especially difficult because the bottles may undergo substantial shipping and storage and a corresponding variety of temperature and pressure conditions before the water is finally consumed.

A number of bottle caps have been employed in an effort to provide adequate sealing properties. The bottles commonly have a neck having an orifice surrounded by a protruding annular lip and a second annular protrusion on the exterior surface of the neck below the lip. Originally a cork and wax paper were inserted into the orifice and the excess waxpaper was wrapped over the orifice lip and held in position by a rubber band around the neck between the lip and the protrusion. Although seals and caps have become more sophisticated, water bottles tend to retain a neck configuration having an annularly protruding orifice-defining lip and a second annular neck protrusion as employed with cork and paper seals.

With the advent of plastic, various plastic cap designs were offered to seal water bottles and the like. In one such design, as disclosed in Faulstich, U.S. Pat. No. 3,066,820, a plastic cap fit over and around the protruding lip and in addition a central cylindrical appendage which was slightly smaller than the orifice was inserted into the orifice to seal against an inside surface of the bottle neck.

Other plastic cap designs were generally cup-shaped and fit over the bottle neck covering the protruding lip and a portion of the annular protrusion. Such a cap is shown in Faulstich, U.S. Pat. No. 3,392,862.

Two shortcomings of these designs were the difficulty with which they could be removed from the bottle and their sealing qualities were not as effective as they might be. One solution to the first shortcoming offered in some commercially available caps was to mold a groove in the interior surface of the cap and to provide a tab depending from a lower edge of the cap and adjacent said groove. The cap could then be removed by lifting on the tab and tearing the cap. While this design ameliorates one shortcoming, it aggravates the other because the formation of a groove on the interior surface of the cap interferred with the formation of a seal between the cap and the bottle neck. Faulstich U.S. Pat. No. 3,392,862 shows a groove which has part of its length molded in the exterior surface of the cap in the region near the annular protrusion of the bottle neck, but which has the rest of its length molded in the interior surface of said cap which partially cures this shortcoming.

The second shortcoming, which has affected all caps, is how effectively to seal the bottle against content loss or contamination. One commercially available cap has two tiny annular beads molded on the interior of the cap which are designed to fit against the top surface of the neck lip. These beads are relatively tiny, i.e., they protrude on the order of 0.010" from the interior surface of the cap. The size and the shape of these beads dictates that the seal formed between the cap and the vessel neck surface is essentially point-to-point and the beads are not of sufficient length to form a surface-to-surface contact with the bottle lip so that sealing contact can be maintained even when the cap and neck deform to some extent because of thermal expansion and contraction and manufacturing variances. These beads thus form an ineffective seal, especially when either the cap or bottle neck has molded imperfections or when the plastic cap is deformed by, for example, temperature changes or pressure gradients across a cap/neck seal. Under any of the above conditions the cap beads may fail to contact the lip surface at some points, thereby breaking the seal.

SUMMARY OF THE INVENTION

By this invention, a closure and sealing device is provided which will be inexpensive to manufacture and capable of use on existing capping machinery and which will be easy to install over a vessel orifice-defining lip, closing and sealing the vessel against contamination and loss of contents by virtue of at least one and preferably a pair of elongated sealing means which are of sufficient length relative to their width to be capable of lateral deformation to create a surface to surface sealing contact with the lip and which are biased toward creating a sealing engagement with a surface of the lip in response to a pressure differential between the interior and the exterior of said bottle.

A further object of this invention is to provide a cap or closure device with a depending skirt portion which will cover and seal against a second protruding vessel neck lip disposed about the exterior of the vessel neck axially below a first protruding vessel lip. The skirt portion desirably has an opening tab depending from its bottom edge and an opening groove formed in the exterior surface of the closure and sealing device and intersecting an edge of the tab. The closure and sealing device can be easily removed from the container by pulling up the tab and tearing the closure and sealing device along the groove.

A still further object of this invention is to provide a closure and sealing device for closing and sealing an orifice defined by a lip protruding radially and axially from the orifice which has a cover portion with a pair of concentric annular elongated sealing means angularly disposed such that they diverge from each other and towards sealing ends which press and seal against a surface of the lip.

Another object of said invention is to provide a closure and sealing device which makes sealing contact at four points on the conventional bottle neck. The first sealing means is a cylindrical skirt portion which depends from a cover portion of the cap, the interior surface of the skirt portion pressing against the second protruding lip when the device is placed over the orifice to form an additional seal. The second sealing means is a relatively massive portion of said skirt portion which presses and seals against the lower surface of the first lip. A pair of annular elongated sealing means, angularly disposed such that they diverge from each other and towards sealing ends, form a pair of seals against the first orifice-defining lip. The pair of elongated sealing means are adapted to form two seals with the first lip surface which tends to remain intact even when there is a pressure differential between the atmosphere and interior of the bottle and/or there is distortion of the cap and/or bottle neck surfaces because of thermal or manufacturing variances.

DESCRIPTION OF THE DRAWINGS

These objects, features and advantages and further objects, features and advantages of the invention will become more apparent as the following detailed description of the preferred embodiment proceeds with continued reference to the drawings wherein.

DETAILED DESCRIPTION OF PREFERRED EMBODIMENT

Figure 1:
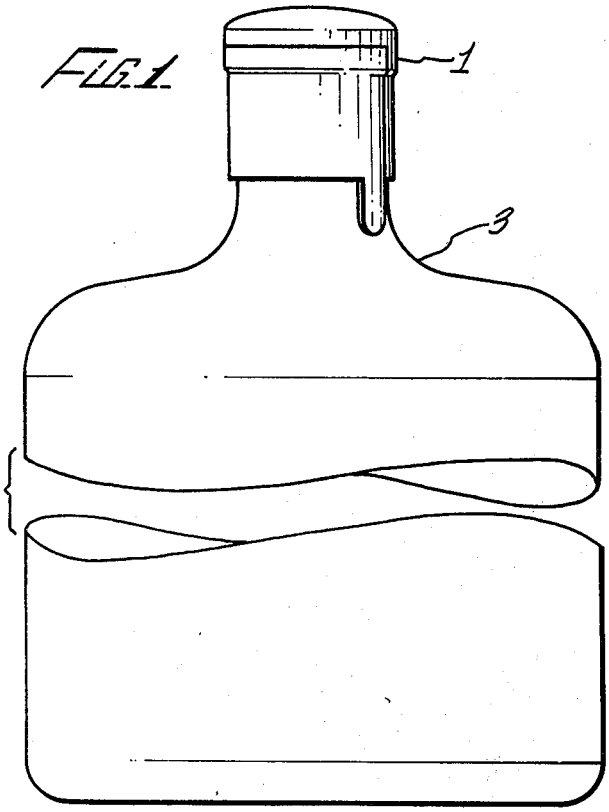
FIG. 1 is a side elevational view of a closure and sealing device in the form of a bottle cap in accordance with the preferred embodiment of the invention in place over the orifice of an open-mouthed vessel or bottle.

Referring now to FIG. 1, a closure device 1 in accordance with the preferred embodiment of the invention is shown as a bottle cap closing and sealing the open mouth of a container or vessel or bottle 3. The closure device 1 is preferably of a material which is malleable and flexible enough to deform for application. Polyethylene has been found to be a suitable material.

Figure 3:
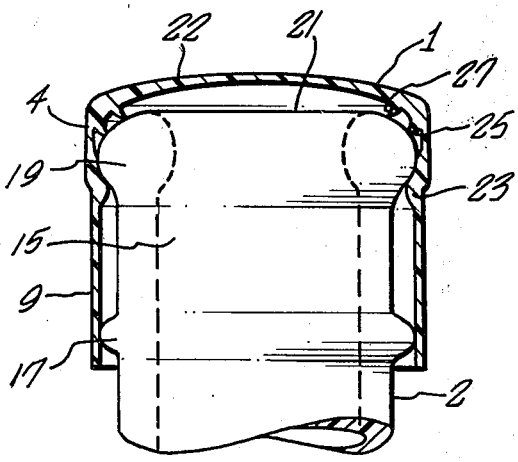
FIG. 3 is a sectional view of the closure and sealing device or cap taken along line 3—3 of FIG. 2.

The vessel 3, as shown in FIG. 3, has an axially projecting neck 15 which terminates in an orifice 21 defined by a rounded first lip 19. The neck 15 also has a second lip 17 protruding radially outward therefrom at a point axially below the first lip 19. (As used herein, the term axial refers to directions or planes or lines parallel to the longitudinal axis of the neck member and the term radial refers to directions or planes or lines perpendicular to that axis.)

The closure device 1 is constructed and arranged to be urged, when in place over the neck 2 (as shown), into sealing engagement with the first lip 19 by excess pressure from the inside of the container 3 or by excess pressure from the outside or ambient atmosphere. The closure device 1 is also constructed to maintain the sealing engagement despite imperfections in the manufacture of said device 1 or said container 3 or deformations in said device caused, for example, by physical blows or temperature changes.

Figure 2:
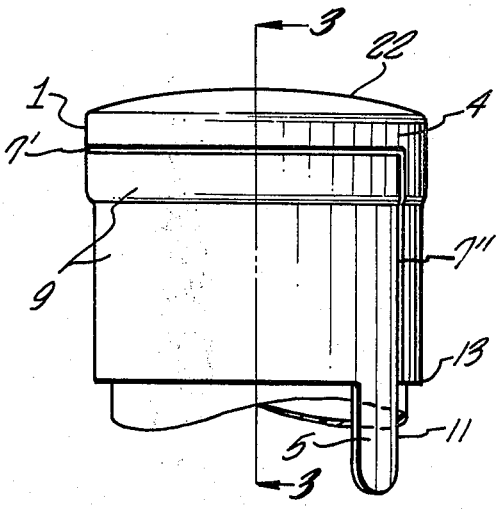
FIG. 2 is an enlarged side elevational view of the cap shown in FIG. 1.

The closure device or cap 1 (as shown in FIG. 2) comprises a generally cup-shaped body 4 with a radially extending cover portion 22 having a shape complementary to the first lip 19 and defined orifice 21 and adapted to surround the first lip 19 and cover the orifice 21 as shown in FIG. 3. The cup-shaped body 4 further has a skirt portion 9 depending axially from the cover portion 2 to cover and seal against the second lip 17 when the closure device is placed over the vessel neck 15. An opening tab 5 (see FIG. 2) depends from the lower portion of the skirt portion 9. One edge 11 of the opening tab is defined by an opening groove 7, preferably formed entirely in the exterior surface of the skirt portion 9. The groove 7 is also shown as preferably having a squared 7-shape, one portion 7' of the groove being parallel to the cover portion 22 and one portion 7'' descending axially from the region of the cover portion to meet the tab edge 11. It is apparent that multiple grooves could be used and also that the groove shape could be altered within the spirit and scope of the invention.

The groove 7 is shown preferably on the exterior of the skirt portion 9 since if it were on the interior of the skirt then gas or liquid could more easily pass between the skirt portion 9 and the second protruding neck lip 17 shown in FIG. 3. In addition, an interior molded groove would eliminate sealing contact between the device 1 and the first lip 19. The squared 7-shape of the groove 7 is shown because it allows one to lift the tab 5 up towards the cover portion 22 tearing the skirt portion 9 along the axial portion of the groove 7 and then further allowing sufficient tearing of the skirt portion 9 in the region of the cover portion 22 to allow removal of the closure device 1.

Figure 4:
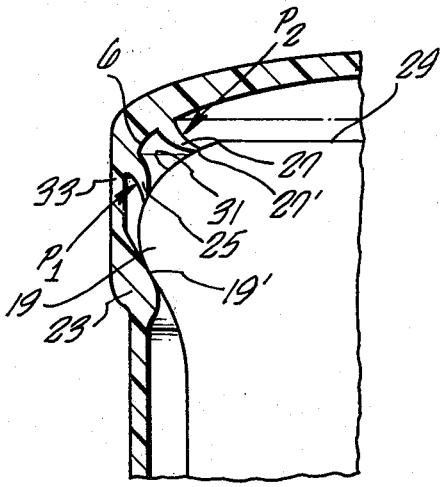
FIG. 4 is an enlarged sectional view of the sealing means of the preferred embodiment of the invention showing the detail of the vessel orifice sealing mechanism shown in the upper left hand corner of FIG. 3.

The closure device 1, as shown in FIGS. 3 and 4, further has elongated sealing means comprising at least one elongated sealing member, and, as shown, preferably two elongated sealing members 25 and 27 extending inwardly from the cup-shaped body 4 and having a configuration complementary to that of the first lip 19 and being constructed and arranged to be urged into sealing engagement with the first lip 19 when the closure device 1 is placed over the orifice defining lip 19. The elongated sealing members 25 and 27 preferably are angularly disposed with respect to the complementary lip surface 31 against which they are adapted to form a seal so as to be urged into further sealing engagement with said lip 19 by a pressure differential between the vessel interior and the atmosphere. By elongated it is meant that the sealing members, when examined in cross-section, are of sufficient length relative to their width to be capable of some lateral deformation in response to pressure differentials to create a type of surface to surface sealing contact with the lip surface 31.

In the preferred embodiment the elongated sealing means consists of an inner, or first, elongated sealing member 27 and an outer, or second, elongated sealing member 25 extending inwardly from the cup-shaped body 4. The sealing members 25 and 27 desirably are angularly disposed to each other so that the first sealing member 27 is urged into further sealing engagement with the first lip 19 when the pressure inside the vessel is greater than the ambient, or atmospheric pressure, and the second sealing member 25 is urged into further sealing engagement with the first lip when the ambient pressure is greater than the pressure inside the vessel.

As shown in FIGS. 3 and 4 the first and second elongated sealing members 27 and 25 are preferably adjacent the junction of the cover portion 2 of the closure device 1. The first sealing member 27 is constructed and arranged to seal against a generally radially extending surface which is an upper portion of the surface 31 of the first lip 19 and the second sealing member 25 is constructed and arranged to seal against a generally axially extending surface which is a lower portion of the first lip surface 31.

As the first and second sealing members 25 and 27 extend inwardly from the body portion 4, from, for example, a common base portion 6, they diverge from each other towards sealing ends 27' and 25' adapted to contact the surface of said first lip 19. The elongated sealing members 25 and 27 are preferably tapered as the members extend from said body 4 with the thinner sealing ends portions 27' and 25' adapted to make firm contact against said lip surface 31 to form a V-type wiper seal and to point away from the region between said sealing members. In the preferred embodiment, the tapered elongated cross-sectional sides of said sealing member may preferably be curved and of different lengths such that their shape is somewhat like a cut-off quartermoon or saber-shape.

The closure device 1 further preferably has a seal augmenting means 23 of greater mass than the elongated sealing members 25 and 27 and the portion of the closure device disposed axially between the sealing means and the seal augmenting means 23. The seal augmenting means 23 is located axially downward from the sealing members 25 and 27 on the skirt portion 9. The seal augmenting means 23 in the preferred embodiment is shown as a rounded ridge bulge projecting radially inward from the skirt portion 9 and pressing against the lower outside surface of the first lip 19. The seal augmenting means 23 and elongated sealing members 25 and 27 are shown in the preferred embodiment as annular rings complementary to the corresponding surfaces of the bottle neck.

The structure shown in FIGS. 3 and 4 illustrates two ways in which these sealing aspects of the invention close and seal the container 3. First, the seal augmenting means 23 and the elongated sealing members 25 and 27 are angularly opposed about the upper and lower surfaces, respectively, of said first lip 19 which preferably has a rounded configuration. Because the closure device 1 is preferably made of an elastic material it can be snapped over the first lip with the seal augmenting means 23 in constriction. The elastic force of the closure device material will then urge the stretched seal augmenting means 23 inward and downward on the lower surface of the first vessel lip 19 since the lip will have a smaller exterior perimeter in those directions. The effect of this movement of the seal augmenting means 23 is to draw the elongated sealing members 25 and 27 into contact with the top of the lip toward the cover portion, thereby creating a gasket type seal, while at the same time forming a sealing engagement between the seal augmenting means 23 and the lower portion of the lip.

The elongated sealing members 25 and 27 are also constructed and arranged to increase the sealing effect in response to pressure differentials between the interior and exterior of the container. When internal pressure P2 in the container is greater than atmospheric or ambient pressure P1, the greater internal pressure P2 tends to press on the inner sealing member 27 urging it to deform laterally and thereby flatten into sealing engagement with lip surface 31. This helps seal the container and prevent loss of container contents when atmospheric pressure is less than internal pressure. Conversely, when atmospheric pressure P1 is greater than internal pressure P2, atmospheric pressure tends to urge the outer sealing member 25 to deform laterally and thereby flatten into sealing engagement with the lip surface 31. Hence the invention provides elongated sealing means which tend to be urged into firmer sealing engagement by any pressure differential between the atmosphere and the interior of the vessel.

The structure of the sealing members described above also assists the invention to maintain a good seal despite temperature, manufacturing or handling problems. The elongated members 25 and 27 allow a seal to be maintained despite defects in production of either the first vessel lip 19 or cap 1 since the elongated members 25 and 27 can within limits either extend out towards the lip surface 31 or be further compressed. Additionally, deformation of the device caused by manufacturing error, physical blows in handling or temperature is compensated for by the biasing of members 25 and 27. Any force which tends to cause the sealing members to be pulled radially inward towards the bottle neck axis will tend to flatten member 25 against the lip surface 31 thereby increasing the sealing effect. Similarly, any force which tends to move the sealing members radially outward from said axis will tend to increase the sealing effect of member 27. Forces on said cap 1 axially downward on said axis also increases the sealing effect of member 27. Finally, upward forces along said axis are resisted by the seal augmenting means 23.

While the preferred embodiment of the present invention has been disclosed, numerous alternatives and equivalents which do not depart from the spirit and scope of the invention will occur to those skilled in the art given the benefit of the present teachings which fall within the scope of the appended claims.

What is claimed is:

1. A closure device for closing and sealing a vessel orifice defined by a vessel lip protruding radially and axially from the orifice comprising:

a generally cup-shaped body having a radially extending cover portion adapted to cover the orifice and a depending skirt portion extending axially from the cover portion adapted to surround and close the orifice defined by the lip;

a first elongated sealing member adjacent the junction of the cover portion and the skirt portion of the closure device extending inwardly from the cup-shaped body portion constructed and arranged to be urged into sealing engagement with the lip upon being placed over the orifice defining lip, the first sealing member being constructed and arranged to seal against a generally radially extending surface of the lip; and a second elongated sealing member adjacent the junction of the cover portion and skirt portion of the closure device extending inwardly from the cup-shaped body portion constructed and arranged to be urged into sealing engagement with the lip upon being placed over the orifice defining lip, the second sealing member being constructed and arranged to seal against a generally axially extending surface of the lip, the first sealing member and the second sealing member being angularly disposed to each other so that the first sealing member is urged into further sealing engagement with the lip when the pressure inside the vessel is greater than the ambient pressure and the second sealing member is urged into further sealing engagement with the lip when ambient pressure is greater than the pressure inside the vessel.

2. A closure device according to claim 1 wherein the first sealing member and the second sealing member extend inwardly from the body portion and divurge from each other for sealing against the orifice defining lip.

3. A closure device according to claim 1 which further comprises a seal augmenting means located on the skirt portion axially from the first and the second sealing members and constructed and arranged to urge the first and the second sealing members into sealing contact with the lip when the closure device is placed over the orifice defining lip.

4. A closure device according to claim 3 wherein the orifice defining lip has a rounded configuration and wherein the first and the second sealing members, the skirt portion and the seal augmenting means are configured to urge the first and the second sealing members axially down toward the top of the orifice defining lip and the seal augmenting means into sealing engagement with the lower portion of the orifice defining lip remote from the cover portion when the closure device is placed over the orifice defining lip.

5. A closure device according to claim 1 in which the skirt portion further comprises an opening tab and an opening groove formed in the exterior of the skirt for removing the closure device from the vessel.

6. A closure device according to claim 1 in which the vessel neck has a second lip protruding radially outward therefrom at a point axially spaced from the orifice defining lip wherein the skirt portion extends axially from the cover portion to cover and seal against the second lip when the closure device is placed over the vessel neck.

7. A closure device having a first and a second sealing member which are biased toward creating a sealing engagement with a vessel neck surface in response to a pressure differential between the interior and the exterior of a bottle for closing and sealing a vessel orifice defined by a lip protruding radially and axially from the orifice, the closure device comprising:

a generally cup-shaped body having a cover portion adapted to cover said orifice and a depending skirt portion extending axially downward from the cover portion adapted to surround said orifice-defining lip;

a first elongated sealing member having a first sealing end;

a second elongated sealing member having a second sealing end, the first and the second elongated sealing members being angularly disposed to divurge from each other as they extend from the interior of the body towards the first and the second sealing ends; and said skirt portion including seal augmenting means located axially downward on the skirt portion, the sealing means being constructed and arranged to urge the sealing means into sealing contact with the lip when the closure device is placed over the lip, the first sealing end being urged into further sealing engagement with the lip when the pressure inside the vessel is greater than the ambient pressure and the second sealing member being urged into further sealing arrangement with the lip when ambient pressure is greater than the pressure inside the vessel.

8. A closure device according to claim 7 wherein the first and the second sealing members are tapered as the first and the second sealing members extend away from the body with the thinner end portions of the first and the second sealing members adapted to contact the surface of the lip.

9. A closure device according to claim 7 wherein the sealing members and the seal augmenting means are annular rings.

10. A closure device according to claim 7 wherein a portion of a skirt portion disposed axially below the sealing augmenting means has at least one exterior opening groove extending axially downward from the skirt portion near the seal augmenting means and further has a descending opening tab extending axially downward from the portion of the skirt portion adapted such that one edge of said opening tab contacts the opening groove such that sufficiently lifting the tab toward the seal augmenting member causes the skirt portion to tear about the exterior groove allowing removal of the closure device from the lip.

11. A closure device according to claim 7 further adapted to seal against a bottle neck having a second protruding lip located axially downward from the orifice defining lip, wherein the skirt portion extends beyond the seal augmenting means so as to be adapted to seal against the second lip when the closure device is placed on the bottom neck.

* * * * *